US010909838B1

(12) United States Patent
Sahai et al.

(10) Patent No.: US 10,909,838 B1
(45) Date of Patent: Feb. 2, 2021

(54) FIRE CONTROL PANEL INTERFACE GENERATION

(71) Applicant: Honeywell International Inc., Morris Plains, NJ (US)

(72) Inventors: Deepika Sahai, New Delhi (IN); Anu Gopinath, Bangalore (IN); Sagar Kulkarni, Bangalore (IN)

(73) Assignee: Honeywell International Inc., Charlotte, NC (US)

( * ) Notice: Subject to any disclaimer, the term of this patent is extended or adjusted under 35 U.S.C. 154(b) by 0 days.

(21) Appl. No.: 16/511,910

(22) Filed: Jul. 15, 2019

(51) Int. Cl.
*G08B 25/14* (2006.01)
*A62C 37/36* (2006.01)

(52) U.S. Cl.
CPC ..... *G08B 25/14* (2013.01); *A62C 37/04* (2013.01)

(58) Field of Classification Search
None
See application file for complete search history.

(56) References Cited

U.S. PATENT DOCUMENTS 7,046,142 B2 * 5/2006 Hershkovitz ..... G08B 25/008 340/506
8,773,254 B2 * 7/2014 Piccolo, III ..... G08B 25/14 340/501
9,569,945 B2 * 2/2017 Zumsteg ..... G08B 17/10
2004/0051739 A1 * 3/2004 Schmickley ..... G08B 25/14 715/772

* cited by examiner

*Primary Examiner* — K. Wong
(74) *Attorney, Agent, or Firm* — Brooks, Cameron & Huebsch, PLLC

(57) ABSTRACT

Methods, devices, and systems for fire control panel interface generation are described herein. In some examples, one or more embodiments include a fire control panel comprising a memory and a processor to execute instructions stored in the memory to determine, from a plurality of geographic regions, a geographic region for the control panel, determine a set of standards corresponding to the determined geographic region, and generate a fire control panel interface using the determined set of standards, and a user interface to display the fire control panel interface.

19 Claims, 2 Drawing Sheets

FIRE CONTROL PANEL INTERFACE GENERATION

TECHNICAL FIELD

The present disclosure relates to methods, devices, and systems for fire control panel interface generation.

BACKGROUND

Facilities, such as commercial facilities, office buildings, hospitals, and the like, may have control systems that can be used during an emergency situation, such as, for instance, a fire, to manage the emergency situation in and/or around the facility. Such control systems may rely on fire hardware devices such as smoke detectors, heat detectors, carbon monoxide (CO) detectors, among other types of fire hardware devices, to detect an emergency event. Upon detection of an emergency event, other fire hardware devices may activate, such as audible alarms, visual alarms, pre-programmed messages on a display, etc.

Fire control panels can control components of a fire control system in a facility. For example, a fire control panel can monitor and/or control fire hardware devices in the facility. For example, in the case of an emergency event such as a fire, a fire control panel can receive signals from a fire hardware device such as a sensor, and/or control other fire hardware devices to perform fire control operations.

DETAILED DESCRIPTION

Figure 1:
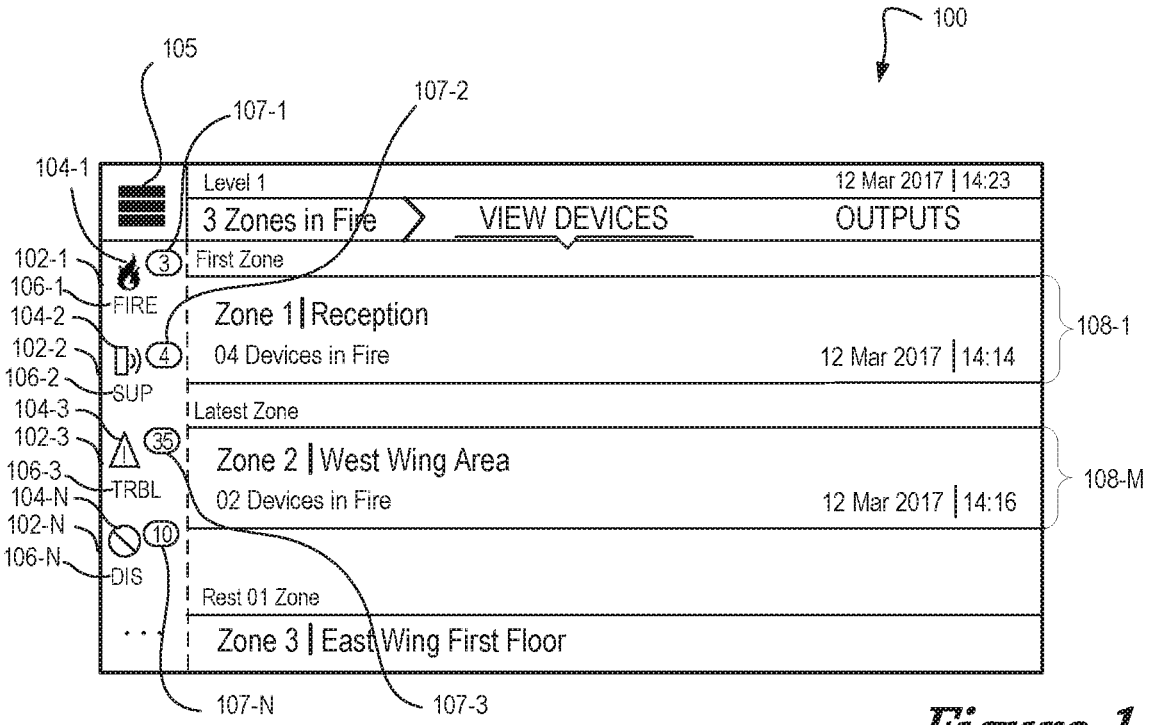
FIG. 1 is an example of an illustration of a fire control panel interface for fire control panel interface generation, in accordance with one or more embodiments of the present disclosure.

Methods, devices, and systems for fire control panel interface generation are described herein. In some examples, one or more embodiments include a fire control panel comprising a memory and a processor to execute instructions stored in the memory to determine, from a plurality of geographic regions, a geographic region for the control panel, determine a set of standards corresponding to the determined geographic region, and generate a fire control panel interface using the determined set of standards, and a user interface to display the fire control panel interface.

Fire control panels can be utilized in a facility to manage fire hardware devices in the facility. As used herein, the term "fire control panel" refers to a controlling component of a fire control system. For example, a fire control panel can receive information from fire hardware devices in the facility, monitor operational integrity of fire hardware devices in the facility, control fire hardware devices in the facility, and/or transmit information about fire hardware devices in the facility, among other operations. As an example, a fire control panel can receive information from, monitor, control, and/or transmit information about sensors in the facility. As used herein, the term "sensor" refers to a device designed to detect and/or report fires.

Fire control panels may be installed in facilities in many different geographic regions. For example, fire control panels may be installed in the United State (country), Europe (group of countries/continent), Australia (country/continent), etc.

Fire control panels installed in different geographic regions may be subject to varying regulatory standards, depending on the geographic region in which it is installed. For example, a fire control panel installed in the United States may be subject to regulatory standards that may not be the same as those regulatory standards in Europe, Australia, etc. A fire control panel installed in the United States may be subject to using certain terminology to describe events (e.g., determined via information received from fire hardware devices in a facility), may be subject to prioritizing those events in a certain way, etc. that may be different from the terminology and/or prioritization schemes mandated by regulatory standards in Europe, Australia, and/or other geographic regions. Additionally, fire control panels installed in some geographic regions may be subject to multiple different regulatory standards.

As a result of such differing regulatory standards, a user such as a commissioning engineer may have to be aware of the geographic region in which the fire control panel is being installed, what regulatory standards the fire control panel is designed with, etc. This may be difficult or confusing for the user, especially for fire control panels installed in a geographic region subject to multiple different regulatory standards.

Fire control panel interface generation, in accordance with the present disclosure, can allow for a fire control panel to include multiple sets of standards such that a fire control panel interface can be generated according to a set of standards based on the geographic region in which the fire control panel is located. In such a manner, the user can more easily and quickly commission and install a fire control panel according to the geographic location of the fire control panel as compared with previous approaches.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that process, electrical, and/or structural changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits. For example, 102 may reference element "02" in FIG. 1, and a similar element may be referenced as 202 in FIG. 2.

As used herein, "a", "an", or "a number of" something can refer to one or more such things, while "a plurality of" something can refer to more than one such things. For example, "a number of components" can refer to one or more components, while "a plurality of components" can refer to more than one component. Additionally, the designators "M" and "N", as used herein particularly with respect to reference numerals in the drawings, indicates that a number of the particular feature so designated can be included with a number of embodiments of the present disclosure. This number may be the same or different between designations.

FIG. 1 is an example of an illustration of a fire control panel interface 100 for fire control panel interface generation, in accordance with one or more embodiments of the present disclosure. Fire control panel interface 100 can be displayed on a user interface of a fire control panel, as will be further described herein (e.g., in connection with FIG. 4).

As illustrated in FIG. 1, the fire control panel interface 100 can include events 102-1, 102-2, 102-3, 102-N (e.g., referred to collectively herein as events 102), icons 104-1, 104-2, 104-3, 104-N (e.g., referred to collectively herein as icons 104), navigation menu 105, terminology 106-1, 106-2, 106-3, 106-N (e.g., referred to collectively herein as terminology 106), event amount 107-1, 107-2, 107-3, 107-N (e.g., referred to collectively herein as event amounts 107), and event information 108-1, 108-M (e.g., referred to collectively herein as event information 108). Examples of the events 102, icons 104, terminology 106, event amounts 107, and event information 108 will be further described herein A fire control panel (e.g., fire control panel 420, further described in connection with FIG. 4) can be utilized to generate a fire control panel interface according to a determined set of standards. As used herein, the term "standards" refers to rules specifying requirements and tests for components of a fire control system. For example, a set of standards can govern construction, installation, control, and/or operation of devices (e.g., fire control panels) included in a fire control system, among other attributes of a fire control system. Sets of standards governing fire control systems may vary based on geographic regions in which such fire control systems are located. As such, the fire control panel interface can be generated based on a determined set of standards that correspond to a particular geographic region in which the fire control panel is located, as is further described herein.

The fire control panel can determine, from a plurality of geographic regions, a geographic region for the fire control panel. Each geographic region can have a different corresponding set of standards associated therewith. For example, in the United States (US), a first set of standards can govern fire control panels, in the European Union (EU), a second set of standards can govern fire control panels, in Australia, a third set of standards can govern fire control panels, etc. Each of the set of standards (e.g., in the US, EU, and/or Australia, among other examples of geographic regions) can be different from each other. In other words, the construction, installation, control, and/or operation of fire control panels included in a fire control system may be governed by differing standards in the US, EU, Australia, and/or other geographic regions.

The fire control panel can determine the geographic region in response to a user input received via the user interface of the fire control panel. The fire control panel can include an input mechanism such as a touchscreen display, mouse and/or keyboard, etc. Utilizing the input mechanism, a user can select (e.g., from a list of geographic regions), the geographic region in which the fire control panel is located. For example, a user can select, via a touchscreen display of the fire control panel, the US in an instance in which the fire control panel is located in the US. Although a user input to the fire control panel is described above as being received via a touchscreen display, mouse and/or keyboard, etc., embodiments of the present disclosure are not so limited. For example, the fire control panel can receive a selection via any other type of input mechanism.

The fire control panel can determine a set of standards corresponding to the determined geographic region. For example, as a result of the selection of the US via a user input, the fire control panel can determine a set of standards corresponding to the US.

The determined set of standards can include pre-determined icons 104 for a number of events. As used herein, the term "event" refers to an occurrence relating to a fire control system of a facility. For example, an event can include a fire event (e.g., fire detection, smoke detection, alarm activation, etc.), supervisory event (e.g., an alarm is suppressed), trouble event (e.g., a fire hardware device experiences operational troubles), fault event (e.g., a fire hardware device experiences operational troubles), test event (e.g., testing of a fire hardware device), disablement event (e.g., disabling of a fire hardware device or devices so that the devices can be maintained and/or repaired without affecting other portions of the fire control system), among other examples of events. Events can be detected via fire hardware devices, sensors, and/or other hardware in the facility.

Each of the events can include an associated pre-determined icon. For example, as illustrated in FIG. 1, event 102-1 can be a fire having an icon 104-1 indicating fire (e.g., an icon in the shape of fire), event 102-2 can be a supervisory event having an icon 104-2 indicating a supervisory action taken for an alarm (e.g., an icon in the shape of an alarm emitting sound), event 102-3 can be a trouble event having an icon 104-3 indicating trouble with a fire hardware device (e.g., an icon in the shape of an exclamation point surrounded by a triangle), and event 102-N can be a disablement event having an icon 104-N indicating a fire hardware device being disabled (e.g., an icon in the shape of a fire hardware device with a line therethrough).

The determined set of standards can include character limits for different labels for a number of events. For example, a fire event can include a label as well as a description of the fire event. The label and description of the fire event on a fire control panel in the US may include character limits that are different than character limits for the label and description of a fire event in the EU.

The fire control panel can generate the fire control panel interface 100 using the determined set of standards. For example, as illustrated in FIG. 1, the fire control panel can generate the fire control panel interface 100 using a set of standards for the US because the determined geographic region for the fire control panel is the US.

Generating the fire control panel interface 100 can include prioritizing a plurality of events 102 received by the fire control panel according to the determined set of standards. For example, the set of standards for the US may dictate prioritizing a fire event 102-1 ahead of a supervisory event 102-2, trouble event 102-3, and a disablement event 102-N, prioritizing a supervisory event 102-2 ahead of a trouble event 102-3 and a disablement event 102-N but behind a fire event 102-1, etc. The events can be included (e.g., displayed) in their prioritized order in the interface 100, as illustrated in FIG. 1.

Generating the fire control panel interface 100 can include color coding the prioritized events according to the determined set of standards. For example, although not illustrated in FIG. 1, the fire event 102-1 can be color coded red, the supervisory event 102-2 and the trouble event 102-3 can be color coded yellow, and the disablement event 102-N can be color coded orange. In some examples, color coding can indicate to a user an importance of a particular event relative to other events according to the standards. For example, a fire event 102-1 (e.g., color coded red) can be a more important (e.g., more severe) event than a trouble event 102-3 (e.g., color coded yellow), among other examples.

In some examples, color coding the prioritized events according to the determined set of standards can include sizing an event on the fire control panel interface 100 according to an event type, health state of the fire control system, and/or importance. For example, although not illustrated in FIG. 1 for clarity, a fire event can be sized such that the event takes up 80% of the fire control panel interface 100 and can be color coded red to indicate to a user, who may be located a distance away from the fire control panel interface 100, the state of the fire control system and/or the facility is under threat (e.g., from a fire). As another example, a supervisory event may be sized such that the event takes up 20% of the fire control panel interface 100 and can be color coded yellow.

Generating the fire control panel interface 100 can include utilizing terminology 106 in the interface corresponding to the determined set of standards for each of the events 102. As used herein, the term "terminology" refers to a system of terms belonging to a particular set of standards. For example, based on the determined set of standards for the US for the fire control panel, the fire control panel can use the term 106-1 "FIRE" for the fire event 102-1, the term 106-2 "SUP" for supervisory event 102-2, the term 106-3 "TRBL" for trouble event 102-3, and the term 106-N "DIS" for disablement event 102-N, as illustrated in FIG. 1. Standards for other geographic regions may utilize different terms for similar event types.

Generating the fire control panel interface 100 can include determining an amount 107 of events 102 of a same event type received by the fire control panel. For example, as illustrated in FIG. 1, the fire control panel has received an amount 107-1 of three fire events 102-1, an amount 107-2 of four supervisory events 102-2, an amount 107-3 of thirty-five trouble events 102-3, and an amount 107-N of ten disablement events 102-N. These amounts can be included in the interface 100 adjacent to their respective event, as illustrated in FIG. 1.

In some examples, the fire control panel interface 100 can display event information 108 for a particular event of the events 102 in response to a selection of the particular event. For example, a user may select (e.g., via a touchscreen of the fire control panel or by other input mechanisms) fire event 102-1. In response, the fire control panel interface 100 can display event information 108-1 and/or 108-M regarding the fire event 102-1.

Event information can include a description of the event, a location of the event, and/or an amount of devices associated with the event. For instance, fire event 102-1 may include event information 108-1 including four devices in a fire event located in Zone 1 "Reception" which occurred on 12 Mar. 2017 at 14:14 and event information 108-M including two devices in a fire event located in Zone 2 "West Wing Area" which occurred on 12 Mar. 2017 at 14:16, etc. Although the event information 108 is illustrated in FIG. 1 as showing information regarding fire event 102-1, embodiments of the present disclosure are not so limited. For example, event information 108 can show information regarding supervisory event 102-2, trouble event 102-3, disablement event 102-N, and/or any other event.

As illustrated in FIG. 1, the fire control panel interface 100 can include navigation menu 105. As used herein, the term "navigation menu" refers to a list of options or commands to move from one portion of an interface to another portion of an interface. For example, the navigation menu 105 can allow a user to navigate between event types, devices, system states, menu options (e.g., menu options 314, described in connection with FIG. 3), administrative options (e.g., user management, firmware updates, fire control panel configuration, etc.), among other portions of the fire control panel interface 100.

Figure 2:
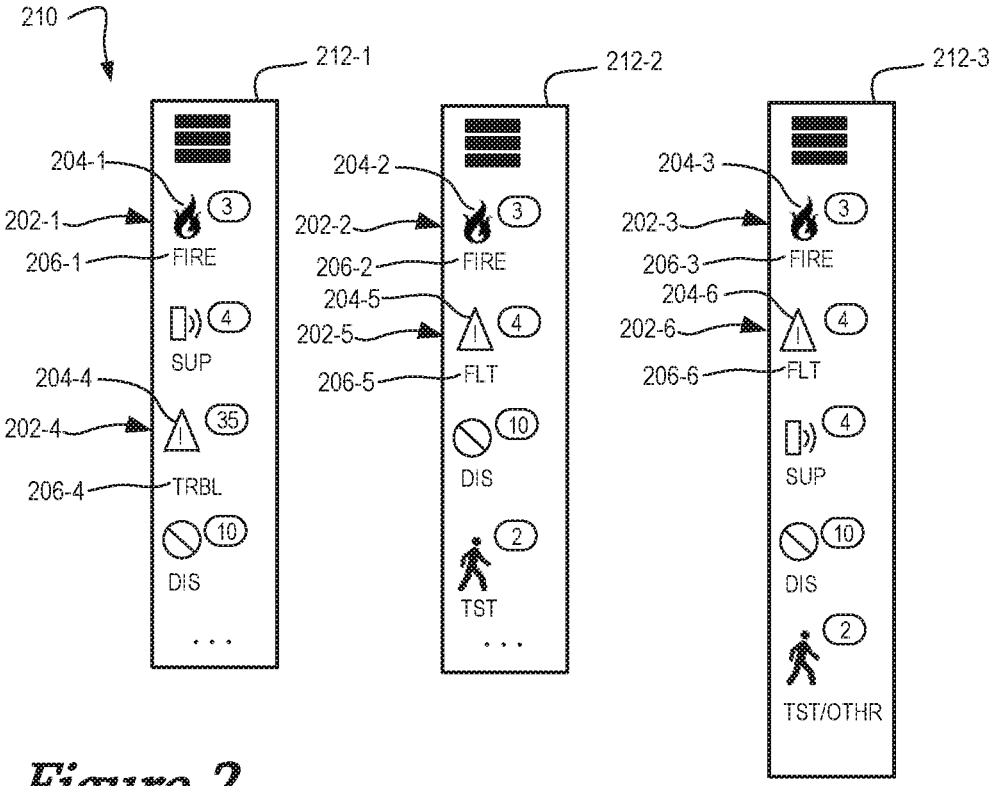
FIG. 2 is an example of an illustration of a fire control panel interface showing prioritized events for different for different sets of standards, in accordance with one or more embodiments of the present disclosure.

FIG. 2 is an example of an illustration of a fire control panel interface 210 showing prioritized events 212 for different for different sets of standards, in accordance with one or more embodiments of the present disclosure. Fire control panel interface 210 can be displayed on a user interface of a fire control panel, as will be further described herein (e.g., in connection with FIG. 4).

As illustrated in FIG. 2, the fire control panel interface 210 can include prioritized events 212-1, 212-2, and 212-3. The prioritized events 212-1 can include events 202-1, 202-4, icons 204-1, 204-4, and terminology 206-1, 206-4. The prioritized events 212-2 can include events 202-2, 202-5, icons 204-2, 204-5, and terminology 206-2, 206-5. The prioritized events 212-3 can include events 202-3, 202-6, icons 204-3, 204-6, and terminology 206-3, 206-6.

As previously described in connection with FIG. 1, a fire control panel can be subject to different sets of standards based on a geographic region where the fire control panel is located. Accordingly, the fire control panel can include sets of standards for a plurality of geographic regions, where each of the different plurality of geographic regions can include a different corresponding set of standards associated therewith. For example, the fire control panel can include a set of standards for the US, a set of standards for the EU, a set of standards for Australia, etc. As previously described in connection with FIG. 1, the fire control panel interface can be generated based on a determined set of standards that correspond to a particular geographic region in which the fire control panel is located.

Generating the fire control panel interface can include prioritizing events 202 according to the determined set of standards. For example, prioritized events 212-1 can be prioritized according to a set of standards for the US such that the fire event 202-1 is prioritized ahead of the supervisory event, trouble event 202-4, and the disablement event. Additionally, prioritized events 212-2 can be prioritized according to a set of standards for the EU such that fire event 202-2 is prioritized ahead of fault event 202-5, the disablement event, and the test event. Further, prioritized events 212-3 can be prioritized according to a set of standards for Australia such that fire event 202-3 is prioritized ahead of fault event 202-6, the supervisory event, the disablement event, and the test/other event. In other words, the order of the prioritized events can be different according to the determined set of standards. That is, the prioritization order of events may be different between different geographic regions (e.g., the US, the EU, Australia, etc.).

Generating the fire control panel interface can include color coding events 202 according to the determined set of standards. For example, although not illustrated in FIG. 2, prioritized events 212-1 can be color coded according to a set of standards for the US such that the fire event 202-1 is color coded red, whereas trouble event 202-4 is color coded yellow, etc. Additionally, prioritized events 212-2 can be color coded according to a set of standards for the EU such that fire event 202-2 is color coded red, fault event 202-5 is color coded yellow, etc. Further, prioritized events 212-3 can be color coded according to a set of standards for Australia such that fire event 202-3 is color coded red, fault event 202-6 is color coded yellow, etc. In other words, the color coding of the events can be different according to the determined set of standards. That is, the color coding of events may be different between different geographic regions (e.g., the US, the EU, Australia, etc.).

As previously described in connection with FIG. 1, each set of standards can include pre-determined icons 204. For example, prioritized events 212-1 can include a fire event 202-1 having an icon 204-1 indicating fire (e.g., an icon in the shape of fire), a trouble event 202-4 having an icon 204-4 indicating trouble with a fire hardware device (e.g., an icon in the shape of an exclamation point surrounded by a triangle), etc. Additionally, prioritized events 212-2 can include a fire event 202-2 having an icon 204-2 indicating fire (e.g., an icon in the shape of fire), a fault event 202-5 having an icon 204-5 indicating a fault with a fire hardware device (e.g., an icon in the shape of an exclamation point surrounded by a triangle), etc. Further, prioritized events 212-3 can include a fire event 202-3 having an icon 204-3 indicating fire (e.g., an icon in the shape of fire), a fault event 202-6 having an icon 204-6 indicating a fault with a fire hardware device (e.g., an icon in the shape of an exclamation point surrounded by a triangle), etc.

In some examples, events of a same event type can include a same corresponding icon in different sets of standards. For example, as illustrated in FIG. 2, event 202-4 (e.g., a trouble event) having an icon in the shape of an exclamation point surrounded by a triangle can be a same event type as event 202-5 (e.g., a fault event) also having an icon in the shape of an exclamation point surrounded by a triangle. In other words, the trouble event 202-4 and the fault event 202-5 can both be an event indicating a problem with a fire hardware device and as such, can include a same corresponding icon even though the trouble event 202-4 is associated with a set of standards for the US and the fault event 202-5 is associated with a set of standards for the EU.

Figure 3:
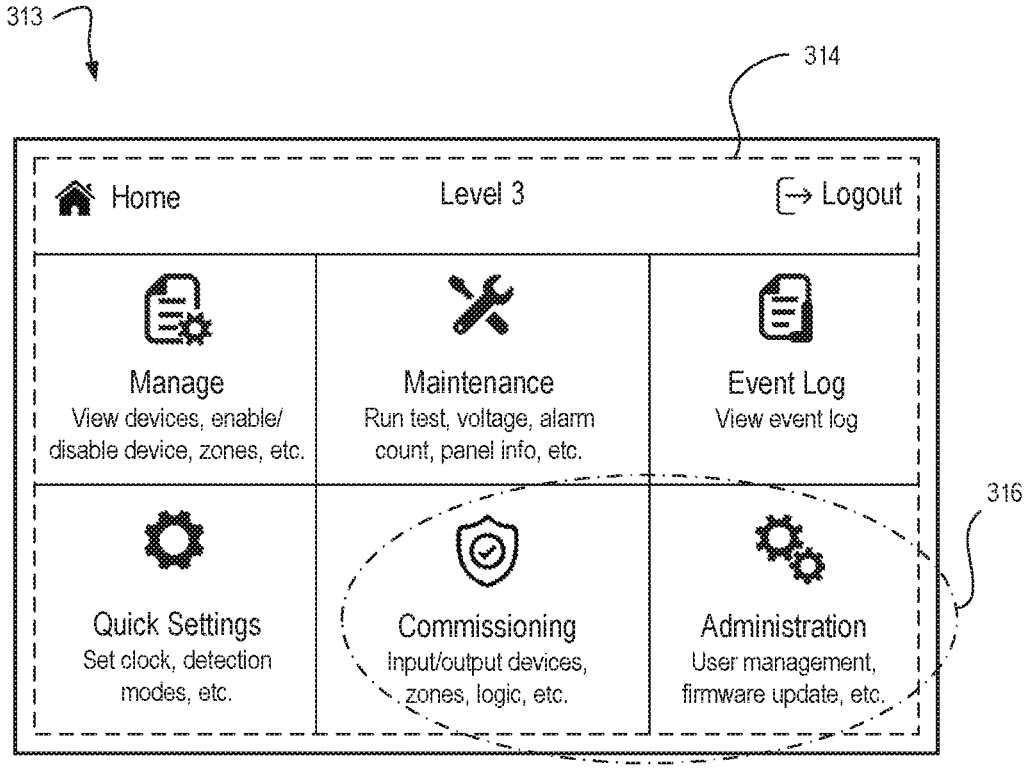
FIG. 3 is an example of an illustration of a fire control panel interface showing menu options, in accordance with one or more embodiments of the present disclosure.

FIG. 3 is an example of an illustration of a fire control panel interface 313 showing menu options 314, in accordance with one or more embodiments of the present disclosure. Fire control panel interface 210 can be displayed on a user interface of a fire control panel, as will be further described herein (e.g., in connection with FIG. 4).

Menu options 314 can include a subset 316 of the menu options 314. Generating the fire control panel interface can include generating menu options 314 for the fire control panel. As illustrated in FIG. 3, menu options can include "Manage" for management of devices (e.g., viewing, enabling, disabling devices, zones, etc.), "Maintenance" for maintenance of devices (e.g., Run test, voltage, alarm count, fire control panel information, etc.), "Event Log" (e.g., viewing an event log), "Quick Settings" (e.g., setting a clock, detection modes, etc.), "Commissioning" (e.g., commissioning the fire control panel including input/output devices, zones, logic, etc.), and/or "Administration" (e.g., user management, firmware/software updates for the fire control panel, etc.).

Although the menu options 314 are described above as being management, maintenance, viewing an event log, quick settings, commissioning, and/or administration, embodiments of the present disclosure are not so limited. For example, the menu options 314 can include any other menu options for a fire control panel.

The menu options 314 can be generated based on user permissions corresponding to an identity of a user accessing the fire control panel. For example, an administrator for the fire control panel may include administrative user permissions which allow the administrator access to all of the menu options 314.

In some examples, a user such as an engineer may include user permissions which give access to less than all of the menu options 314, as is further described herein. For example, a subset 316 of the generated menu options 314 may be disabled based on the user permissions corresponding to the identity of the user. For example, the engineer may not have access to the subset 316 of the menu options 314 due to the user permissions of the engineer. In other words, the engineer may have access disabled to the commissioning and administration menu options.

Fire control panel interface generation, in accordance with the present disclosure, can allow for a fire control panel to generate different fire control panel interfaces based on a set of standards corresponding to a geographic region in which the fire control panel is located. Allowing a user to select the geographic region and allowing the fire control panel to generate a fire control panel interface based on the selected geographic region can allow for easier and quicker commissioning of a fire control panel, as compared with previous approaches.

Figure 4:
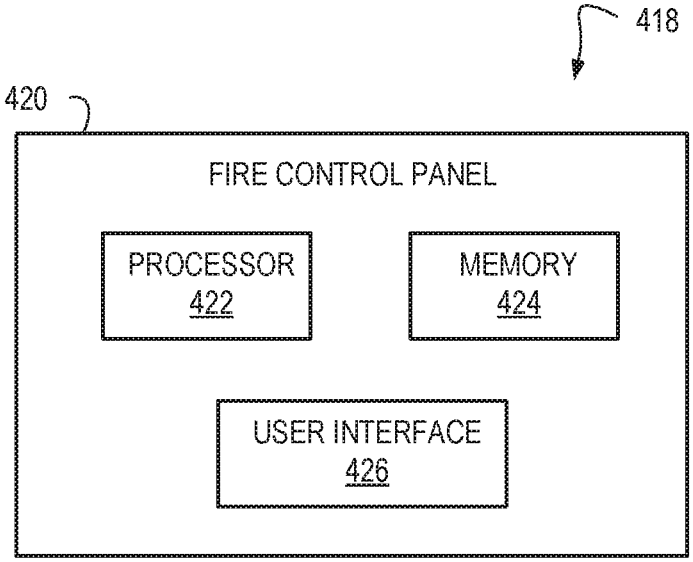
FIG. 4 is an example of a fire control panel for fire control panel interface generation, in accordance with one or more embodiments of the present disclosure.

FIG. 4 is an example of a fire control panel 420 for fire control panel interface generation, in accordance with one or more embodiments of the present disclosure. Fire control panel 420 can include a processor 422, memory 424, and user interface 426.

The memory 424 can be any type of storage medium that can be accessed by the processor 422 to perform various examples of the present disclosure. For example, the memory 424 can be a non-transitory computer readable medium having computer readable instructions (e.g., computer program instructions) stored thereon that are executable by the processor 422 for fire control panel interface generation in accordance with the present disclosure.

The memory 424 can be volatile or nonvolatile memory. The memory 424 can also be removable (e.g., portable) memory, or non-removable (e.g., internal) memory. For example, the memory 424 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disc read-only memory (CD-ROM)), flash memory, a laser disc, a digital versatile disc (DVD) or other optical storage, and/or a magnetic medium such as magnetic cassettes, tapes, or disks, among other types of memory.

Further, although memory 424 is illustrated as being located within fire control panel 420, embodiments of the present disclosure are not so limited. For example, memory 424 can also be located internal to another computing resource (e.g., enabling computer readable instructions to be downloaded over the Internet or another wired or wireless connection).

As illustrated in FIG. 4, fire control panel 420 can include a user interface 426. For example, the user interface 426 can display a fire control panel interface generated in accordance with the present disclosure (e.g., as previously described in connection with FIGS. 1-3).

A user (e.g., operator) of fire control panel 420 can interact with fire control panel 420 via user interface 426.

For example, user interface 426 can provide (e.g., display and/or present) information to the user of fire control panel 420, and/or receive information from (e.g., input by) the user of fire control panel 420. For instance, in some embodiments, user interface 426 can be a graphical user interface (GUI) that can provide and/or receive information to and/or from the user of fire control panel 420. The user interface 426 can be, for instance, a touchscreen (e.g., the GUI can include touchscreen capabilities). Alternatively, the user interface 426 can be a television, computer monitor, mobile device screen, other type of display device, or any combination thereof, connected to fire control panel 420 and configured to receive a video signal output from the fire control panel 420.

As an additional example, user interface 426 can include a keyboard and/or mouse the user can use to input information into computing device 636. Embodiments of the present disclosure, however, are not limited to a particular type(s) of user interface.

User interface 426 can be localized to any language. For example, user interface 426 can display the aircraft stand management in any language, such as English, Spanish, German, French, Mandarin, Arabic, Japanese, Hindi, etc.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A fire control panel for fire control panel interface generation, comprising:

a memory; and a processor configured to execute instructions stored in the memory to:

determine, from a plurality of geographic regions, a geographic region for the fire control panel, wherein each of the plurality of geographic regions is a different country or group of countries having a different corresponding set of fire control panel standards associated therewith;

determine the corresponding set of fire control panel standards associated with the determined geographic region; and generate a fire control panel interface using the determined set of fire control panel standards; and a user interface configured to display the fire control panel interface.

2. The fire control panel of claim 1, wherein generating the fire control panel interface includes prioritizing events according to the determined set of fire control panel standards.

3. The fire control panel of claim 2, wherein generating the fire control panel interface includes color coding the prioritized events according to the determined set of fire control panel standards.

4. The fire control panel of claim 1, wherein generating the fire control panel interface includes utilizing terminology corresponding to the determined set of fire control panel standards.

5. The fire control panel of claim 1, wherein the determined set of fire control panel standards includes a predetermined icon for a number of events.

6. The fire control panel of claim 1, wherein the processor is configured to execute the instructions to determine the geographic region in response to a user input received via the user interface.

7. The fire control panel of claim 1, wherein generating the fire control panel interface includes generating menu options for the fire control panel.

8. The fire control panel of claim 7, wherein the processor is configured to execute the instructions to generate the menu options based on user permissions corresponding to an identity of a user accessing the fire control panel.

9. The fire control panel of claim 8, wherein a subset of the generated menu options is disabled based on the user permissions corresponding to the identity of the user.

10. A non-transitory computer readable medium having computer readable instructions stored thereon that are executable by a processor to:

determine, from a plurality of geographic regions, a geographic region for a fire control panel, wherein each geographic region of the plurality of geographic regions is a different country or group of countries having a different corresponding set of fire control panel standards associated therewith;

determine the corresponding set of fire control panel standards associated with the determined geographic region;

generate a fire control panel interface using the determined set of fire control panel standards, including:

prioritizing a plurality of events received by the fire control panel according to the determined set of fire control panel standards; and utilizing terminology corresponding to the determined set of fire control panel standards for each event of the plurality of events; and display, via a user interface, the fire control panel interface.

11. The medium of claim 10, wherein generating the fire control panel interface includes displaying event information for a particular event of the plurality of events in response to a selection of the particular event.

12. The medium of claim 10, wherein:

the determined geographic region has a first set of fire control panel standards associated therewith and a different geographic region of the plurality of geographic regions has a second set of fire control panel standards associated therewith;

the first set of fire control panel standards includes a different corresponding icon for a number of different event types; and the second set of fire control panel standards includes a different corresponding icon for a number of different event types.

13. The medium of claim 12, wherein events of a same event type have a same corresponding icon in the first set of fire control panel standards and the second set of fire control panel standards.

14. The medium of claim 10, wherein generating the fire control panel interface includes determining an amount of events of a same event type of the plurality of events received by the fire control panel.

15. A method for fire control panel interface generation, comprising:

determining, via a user input received via a user interface of a fire control panel, a geographic region for the fire control panel from a plurality of geographic regions, wherein each geographic region of the plurality of geographic regions is a different country or group of countries having a different corresponding set of fire control panel standards associated therewith;

determining, by the fire control panel, the corresponding set of fire control panel standards to associated with the determined geographic region;

generating, by the fire control panel, a fire control panel interface using the determined set of fire control panel standards, including:

prioritizing a plurality of events received by the fire control panel by importance according to the determined set of fire control panel standards; and utilizing terminology corresponding to the determined set of standards for each event of the plurality of events; and displaying, on the user interface, the fire control panel interface.

16. The method of claim 15, wherein generating the fire control panel interface includes color coding the prioritized plurality of events based on the importance according to the determined set of fire control panel standards.

17. The method of claim 15, wherein the user input comprises a selection of the geographic region from the plurality of geographic regions.

18. The method of claim 15, wherein the method includes displaying, on the user interface, event information for a particular event of the plurality of events in response to a selection of the particular event.

19. The method of claim 18, wherein the event information includes:

a description of the event;

a location of the event; and an amount of devices associated with the event.

* * * * *